US005389164A

United States Patent [19]

Yoshie et al.

[11] Patent Number: 5,389,164

[45] Date of Patent: Feb. 14, 1995

[54] PRODUCTION METHOD OF STRONG AND TOUGH THICK STEEL PLATE

[75] Inventors: Atsuhiko Yoshie; Takashi Fujita; Masaaki Fujioka, all of Futtsu; Yuji Nomiyama, Oita; Hiroki Miyawaki, Futtsu, all of Japan

[73] Assignee: Nippon Steel Corporation, Tokyo, Japan

[21] Appl. No.: 192,875

[22] Filed: Feb. 7, 1994

[30] Foreign Application Priority Data

| | | | |
|---|---|---|---|
| Feb. 10, 1993 | [JP] | Japan | 5-022901 |
| Feb. 16, 1993 | [JP] | Japan | 5-026879 |
| Feb. 18, 1993 | [JP] | Japan | 5-029143 |
| Sep. 8, 1993 | [JP] | Japan | 5-223610 |

[51] Int. Cl.[6] ..... C21D 8/02

[52] U.S. Cl. ..... 148/547; 148/546; 148/654

[58] Field of Search ..... 148/546, 547, 654

[56] References Cited

FOREIGN PATENT DOCUMENTS

| | | | |
|---|---|---|---|
| 49-7291 | 2/1974 | Japan . | |
| 57-21007 | 5/1982 | Japan . | |
| 57-177834 | 11/1982 | Japan | 148/654 |
| 59-14535 | 4/1984 | Japan . | |
| 59-182916 | 10/1984 | Japan . | |
| 61-235534 | 10/1986 | Japan . | |
| 3232923 | 10/1991 | Japan | 148/654 |
| 5271860 | 10/1993 | Japan . | |
| 5271861 | 10/1993 | Japan . | |

*Primary Examiner*—Deborah Yee
*Attorney, Agent, or Firm*—Kenyon & Kenyon

[57] ABSTRACT

A steel containing predetermined components is rolled in a recrystallization temperature region or a non-recrystallization temperature region of an austenite and is subsequently subjected to repeated hot bending. Alternatively, a surface layer portion is cooled during rolling of the steel described above to an $\alpha$ single phase or a $\gamma/\alpha$ dual phase temperature region, rolling is then effected and is finished at the point of time when the surface temperature of the plate rises above an $Ac_3$ point due to recuperative heat, and repeated bending is carried out. Still alternatively, the steel described above is rolled to a cumulative reduction ratio of at least 20% in the non-recrystallization temperature region and is then subjected to repeated bending. Further alternatively, the surface layer portion is cooled during hot rolling of the steel described above to an $\alpha$ single or $\gamma/\alpha$ dual phase temperature region, rolling is then continued at a cumulative reduction ratio of at least 20% and is finished at the point when the surface temperature of the steel plate rises less than ($Ac_3$ point—200° C.) due to recuperative heat, and subsequently, repeated bending is carried out.

15 Claims, 4 Drawing Sheets

$$\varepsilon = \Sigma_i \mid \varepsilon\,\mathrm{TENSION}_i \text{ OR } \varepsilon\,\mathrm{COMPRESSION}_i \mid$$

$i$: ORDER OF BENDING WORK $\varepsilon = \Sigma_i \mid \varepsilon\,\text{TENSION}_i \text{ OR } \varepsilon\,\text{COMPRESSION}_i \mid$ $i$: ORDER OF BENDING WORK

PRODUCTION METHOD OF STRONG AND TOUGH THICK STEEL PLATE

BACKGROUND OF THE INVENTION

1. Field of the Invention

The present invention provides a thick steel plate having excellent strength and toughness and furthermore a thick steel plate devoid of material anisotropy and having excellent brittle crack propagation stop characteristics.

2. Description of the Related Art

Properties of a thick steel plate used as structural members or for other purposes are determined by its chemical components and heat treatment. Recently, production of a thick steel plate having excellent strength and toughness has become possible by a controlled rolling method predominantly comprising rolling at a low temperature and by an accelerated cooling method which conducts cooling in succession to rolling. Such production techniques are described in Japanese Examined Patent Publication (Kokoku) Nos. 49-7291, 57-21007, and 59-14535.

In controlled rolling in general, austenite grains are made fine in a high temperature region by recrystallization and further drawn sufficiently under the non-crystallized state in a low temperature region to obtain fine ferrite by transformation in a subsequent accelerated cooling process.

However, when such rolling in the recrystallization temperature region and rolling in the non-recrystallization temperature region are combined, the problem remains that a long waiting period is necessary for the drop of the rolling temperature and thus the productivity is remarkably impeded. Another problem resides in that the effect of rolling is lost during the period from the end of rolling in the non-recrystallization temperature region to the start of accelerated cooling (mainly because of the decrease of the dislocation density introduced by rolling), and the effect of rolling in the non-recrystallization temperature region cannot be exploited fully.

Still another problem resides in that when rolling is finished in the non-recrystallization temperature region, the rolled aggregate texture is transferred as such to the texture after rolling and material anisotropy increases. When rolling is carried out in the recrystallization temperature region in order to prevent this material anisotropy, there occurs the problem that since the rolling temperature is high, the grain growth after recrystallization is so fast that the crystal grains become coarse. When rolling is finished in a temperature region as low as possible within the range in which recrystallization can take place, however, partial recrystallization is likely to occur and duplex grains develop and cause deterioration of the material. Accordingly, there is a limit to the lowering of the rolling temperature.

The structural members must have excellent brittle crack propagation stop characteristics as one of the required characteristics.

As one of the metallurgical factors that affect brittle crack propagation characteristics when brittle breakdown occurs, it is well known that fine granulation of the crystal grains improves the brittle crack propagation stop characteristics. For this reason, a large number of attempts have been made in the past to make the crystal grains finer, and a thick steel plate having fine crystal grains has become available by a controlled rolling method in a low temperature region or by an accelerated cooling method which conducts cooling in succession to rolling, for example. Such a technique is described in Japanese Examined Patent Publication (Kokoku) Nos. 49-7291, 57-21007, and 59-14535.

Fine granulation of the crystal grains of a plate surface portion is extremely effective for improving the brittle crack propagation stop characteristics. Therefore, Japanese Unexamined Patent Publication (Kokai) No. 61-235534, Japanese Patent Application No. 4-67514, and Japanese Patent Application No. 4-67515 disclose a fine granulation method which combines water cooling during rolling with rolling. All of these related art references disclose the fine granulation method which cools the surface layer portion of the plate with water during rolling so as to bring the texture into an austenite-ferrite dual phase state or a ferrite single phase, conducts rolling during the process in which the temperature of the surface portion of the plate recuperates and rises by heat transfer inside the plate, so as to make the ferrite crystal grains fine and to introduce a rolling strain into the austenite, and eventually makes the crystal grains of the surface portion of the plate fine after transformation.

However, the method described in Japanese Patent Application Nos. 4-67514 and 4-67515 and Japanese Unexamined Patent Publication (Kokai) No. 59-182916 essentially stipulates the requirement that the highest arrival temperature of the plate surface portion by recuperation after water cooling be less than an $Ac_3$ point to make the crystal grains of the plate surface portion finer. Accordingly, the machined texture of the ferrite remains and the toughness drops.

On the other hand, Japanese Unexamined Patent Publication (Kokai) No. 61-235534 prevents residual machined texture from occurring by stipulating the essential requirement that the temperature of the plate surface portion after water cooling be recuperated to a point above the $Ac_3$ point by heat transfer inside the plate. However, since the recuperative temperature exists on a higher temperature side, the resulting crystal grains become greater than those obtained by the method of Japanese Patent Application Nos. 4-67514 and 4-67515, and the brittle crack propagation stop characteristics, too, tend to be inferior.

There are various hot machining methods, and bending is one of them. A strain can be imparted without changing the plate thickness by repeating bending. However, there remains the problem that the strain imparted by bending is generally great in a plate surface portion and is not sufficiently imparted in the center portion in the direction of the plate thickness. For this reason, bending is employed primarily for improving the flatness of the plate but is not used for improving the material properties, in many cases. Japanese Examined Patent Publication (Kokoku) No. 1-16210 discloses a technology which improves a drilling ratio by hot molding a fine grain ferrite, but this reference does not describe the crystal condition between the strain during hot molding and the crystal grains, and so forth.

SUMMARY OF THE INVENTION

It is an object of the present invention to provide a thick steel plate which solves the problems with the related art steel plates described above and has excellent strength and toughness.

It is another object of the present invention to provide a thick steel plate which has excellent strength and toughness as well as excellent brittle crack propagation stop characteristics.

It is still another object of the present invention to provide a thick steel plate which has excellent strength and toughness but is free from material anisotropy.

To accomplish the objects described above, the present invention conducts rolling of an ingot or a slab at a high reduction ratio in a temperature region above an $Ar_3$ point or an $Ac_3$ point, conducts repeated bending in an austenite non-recrystallization temperature region so as to remarkably increase the dislocation density inside the austenite grains and to make the crystal grains after ferrite transformation extremely fine (below about 5 μm), and achieves a high toughness of the thick steel plate by such a texture.

In this case, it is also possible to finely recrystallize the austenite by conducting repeated bending in the austenite recrystallization temperature region after rolling is carried out in the austenite non-recrystallization temperature region, and in such a case, a thick steel plate free from material anisotropy can be produced.

It is further possible to employ a method which compulsively cools the ingot or the slab before, or during, rolling at a high reduction ratio, so as to convert the surface into the austenite-ferrite dual phase texture or the ferrite single phase texture, then applies repeated bending to the rolled steel plate after transformation to the austenite single phase or the rolled steel plate having the ferrite single phase texture so as to secure a large number of nucleid formation sites for ferrite transformation, or recrystallizes the ferrite to make the metallic texture after transformation or after recrystallization extremely fine (to below about 1 μm). In this way, a strong and tough thick steel plate having excellent brittle crack propagation stop characteristics can be produced.

DESCRIPTION OF THE PREFERRED EMBODIMENTS

Hereinafter, the present invention will be explained in further detail.

(1) When bending is repeatedly effected in the austenite non-recrystalline temperature region Generally, the crystal grain size of the steel plate finally obtained after transformation is determined by the austenite crystal grain size before transformation and the dislocation density introduced into the austenite by rolling. In other words, the finer the austenite crystal grain size before transformation and the greater the dislocation density in the austenite before transformation, the finer the crystal grain size after transformation and the more excellent the material properties.

However, the quantity of the former is determined by the rolling condition in the recrystallization temperature region and the quantity of the latter is determined by the rolling condition in the non-recrystallization temperature region. Therefore, each of these quantities has an inherent limit when the slab thickness before rolling and the plate thickness after rolling are determined.

The inventors of the present invention have found a method which brings the austenite crystal grain size before transformation and the dislocation density in the austenite into a more desirable state by the combination of rolling with repeated bending after rolling. Since bending can impart strain without changing the plate thickness, it is not limited by the slab thickness and the plate thickness after rolling.

Figure 1:
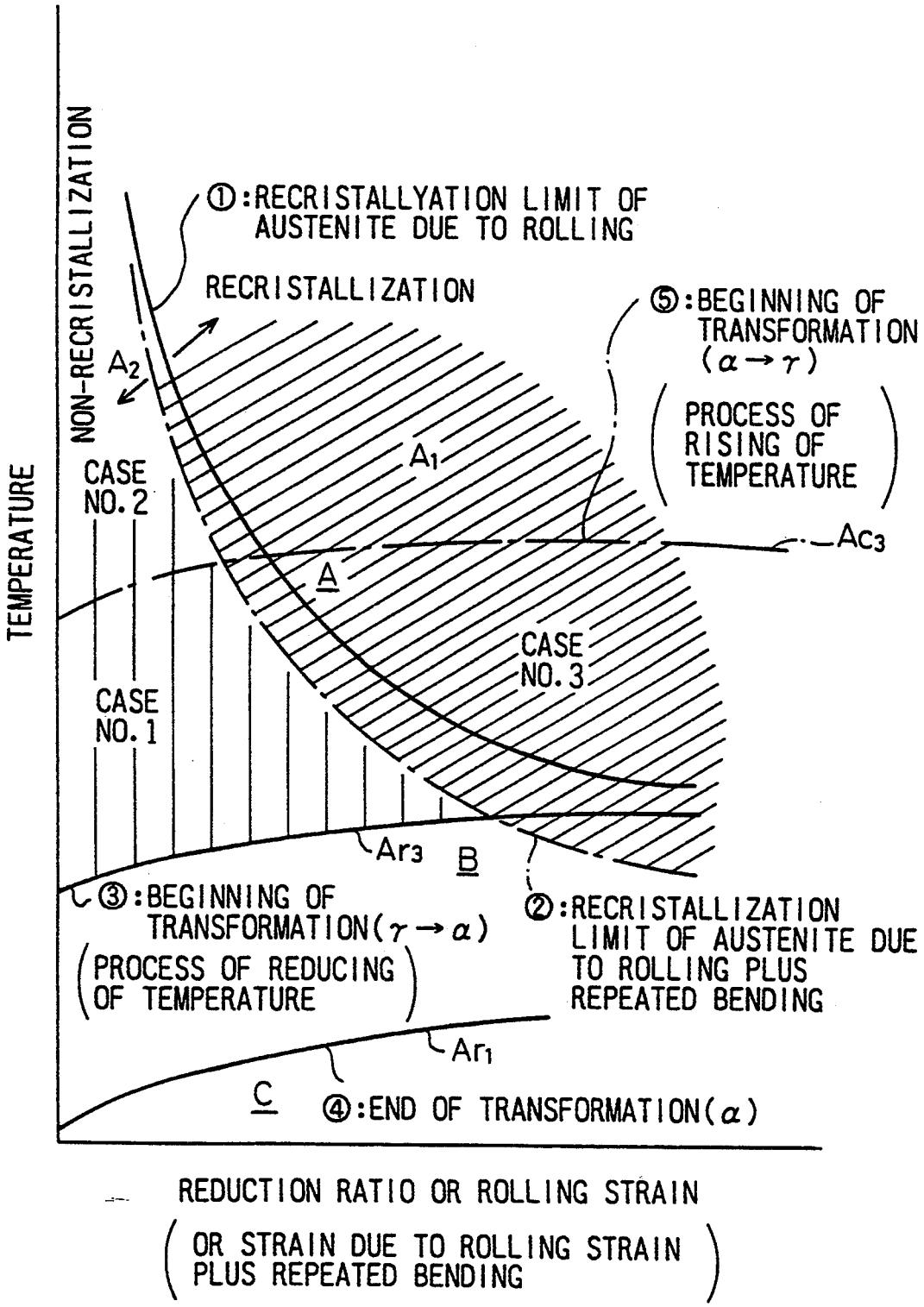
FIG. 1 schematically shows the relationship between a reduction ratio or a rolling strain (or strain due to the rolling strain plus repeated bending) and a temperature when rolling or repeated bending is applied to a slab and schematically shows an austenite recrystallization temperature region and a transformation temperature in a temperature descension process.

FIG. 1 shows the relation between the reduction ratio or the rolling strain (leveler machining strain) and the temperature (the recrystallization temperature and the transformation temperature in the temperature lowering process) in the case where an ingot or a slab (hereinafter referred to as the "slab") consisting of the components according to the present invention is casted and is then directly rolled or repeatedly bent (hereinafter referred to as the "leveler machining") by utilizing the casting temperature in the temperature lowering process, or in the case where the slab described above is once cooled to a temperature below the $Ar_1$ point and then heated to a temperature above the $Ac_3$ point.

In the figure, ① is a line representing the recrystallization limit of the austenite due to rolling, ② is a line representing the recrystallization limit of the austenite when leveler machining is further carried out after rolling, ③ is a line representing the start of the austenite-ferrite transformation, and ④ is a line representing completion of the ferrite transformation. Symbol A represents the region of the austenite phase, $A_1$ is the recrystallization temperature region, and $A_2$ is the non-crystallization temperature region. Symbol B represents the region which is under transformation from the austenite to the ferrite, and symbol C is mainly the region of the ferrite phase.

In the case (1) described above, rolling having a cumulative reduction ratio of at least 20% is completed in the austenite recrystallization temperature region $A_1$or in the austenite non-recrystallization temperature region $A_2$ and subsequently leveler machining is carried out in the austenite non-recrystallization temperature region $A_2$ so as to impart a desired quantity of strain. In this way, the ferrite crystal grain size can be made small below 5 microns after ferrite transformation due to cooling after leveler machining.

When rolling is finished in the austenite recrystallization temperature region $A_1$, the full reduction quantity of rolling can be allotted to recrystallization and to the reduction of the grain size. Accordingly, the austenite crystal grain size can be made extremely fine. When leveler machining is thereafter applied in the non-recrystallization temperature region $A_2$, the dislocation density inside the extremely small austenite grain can be increased. In this way, the crystal grain size after transformation becomes extremely small, and the thick steel plate becomes strong and tough.

On the other hand, when rolling is finished in the non-recrystallization temperature region $A_2$, the dislocation density built up inside the austenite grains reaches saturation due to the balance of work hardening and dynamic recovery according to the existing rolling technique, even though the reduction ratio in the non-recrystallization temperature region is increased to a certain extent. Hence, the effect of rolling on the reduction of the crystal grain size after transformation is limited.

Further, the effect of reduction falls in the period from the end of rolling until the start of accelerated cooling (mainly because of the decrease of the dislocation density introduced by rolling), and the effect of rolling further drops. However, when leveler machining, which is a different machining mode, is applied to the dislocation density inside the austenite which is in the saturated state due to rolling in the non-recrystallization temperature region, the arrangement of dislocation inside the austenite grains changes, and the dislocation density increases, too.

Accordingly, the nucleid formation sites increase during subsequent transformation, and the crystal grain size after transformation can be reduced to about several microns in the case of the ferrite texture as described above.

In this way, a thick steel plate can be made strong and tough. The leveler machining temperature in this case is predominantly the non-recrystallization temperature region $A_1$ of the austenite described above, but may be below the $Ar_3$ point but above the $Ar_1$ point in which partial transformation occurs. Further, transformation can be caused to occur before the dislocation density introduced by leveler machining decreases, by shortening the leveler machining time and the accelerated cooling time.

By the way, when the plate temperature is high at the time of leveler machining, the effect of machining strain is likely to drop. Therefore, the strain quantity to be imparted by leveler machining must be increased at a higher temperature, and this strain quantity (%) is determined in accordance with the following formula:

$$E \geqq 1.71\times10^{-3}T-0.4 \quad (1)$$

where

E: sum of strain which the plate surface portion receives at the time of repeated bending, T: surface temperature (°C.) of the thick steel plate when repeated bending is carried out.

In the case (1) described above, leveler machining is carried out in the austenite non-recrystallization temperature region. Therefore, the upper limit of the sum (E) of the strain is stipulated to be less than a strain quantity obtained by the formula of the strain quantity (formula (3) of the case (3)), when rolling in the non-recrystallization region plus leveler machining are carried out in the austenite recrystallization temperature region:

$$E \geqq -1.14\times10^{-3}T+2.4 \quad (3)$$

In other words, the sum (E) must satisfy the following relational formula:

$$-1.14\times10^{-3}T+2.4 > E \geqq 1.71\times10^{-3}T-0.4$$

Figure 3:
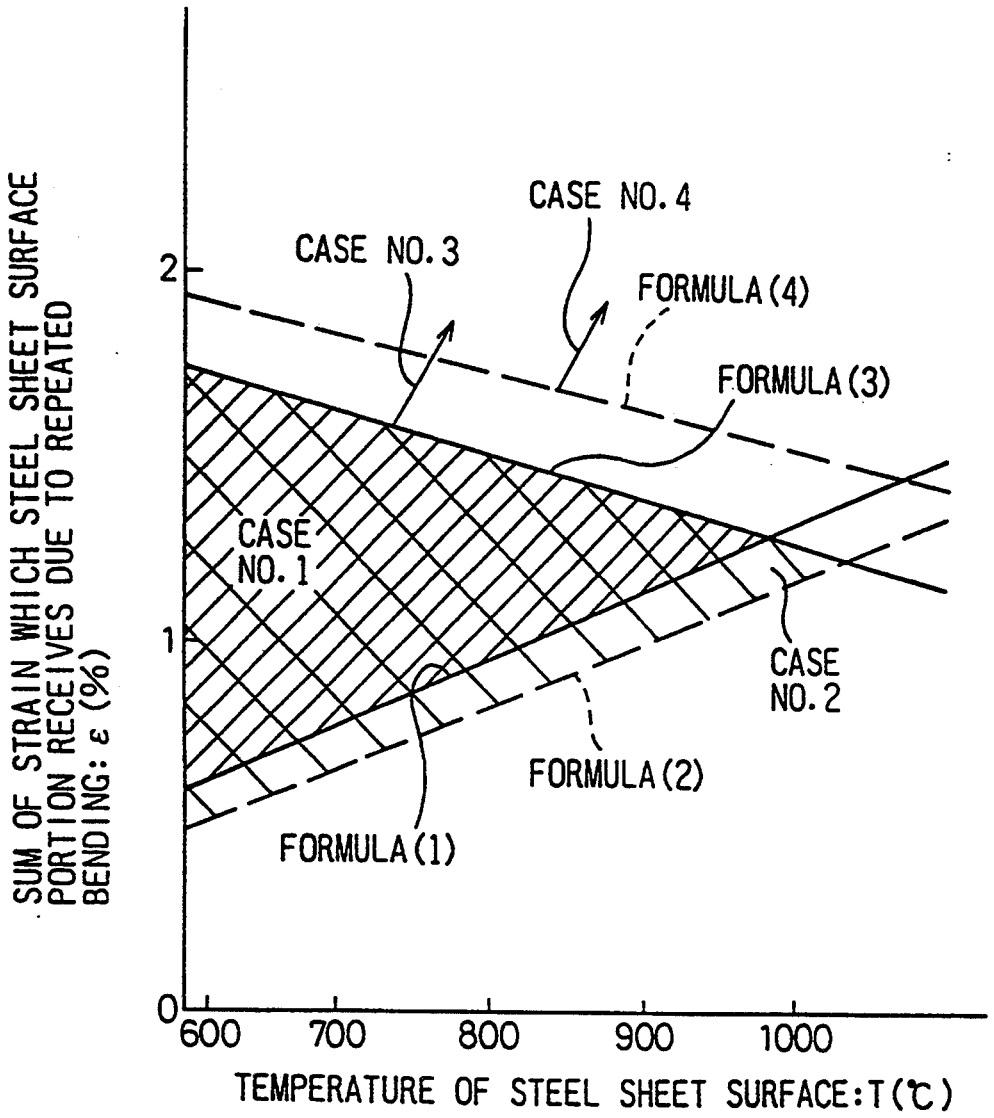
FIG. 3 shows the relationship between the sum (E (%)) of the strain which a steel plate surface portion receives due to repeated bending and a steel plate surface temperature (T (°C.))

The relationship described above is shown in FIG. 3. In other words, FIG. 3 shows the relationship between the sum of the strain (E (%)) which the steel plate surface portion receives during leveler machining and the steel plate surface temperature (T (°C.)). The case (1) described above exists inside the region encompassed by the formulas (1) and (3) in FIG. 3.

After leveler machining is completed, the work must be quickly passed through the ferrite transformation end line 4, that is, the $Ar_1$ transformation point, in order to obtain the ferrite grains having a very small size. Accordingly, though the effect of reducing the grain size after transformation can be obtained to a certain extent by leaving the workpiece standing for cooling, the effect becomes remarkable when cooling is carried out at a mean cooling rate of 0.5 to 80° C./cm in the direction of the plate thickness.

To produce the ferrite-pearlite steel and the ferrite-bainite steel, it is preferred to quickly start cooling after completion of leveler machining as soon as possible and to cool the steel down to about 500° C.

To produce steels consisting principally of bainite and the martensite, quenching is started as soon as possible after completion of leveler machining and then tempering is carried out in an ordinary tempering temperature region.

Leveler machining can be carried out by a hot leveler or repeated bending using roll bending.

(2) Case where the plate surface is cooled and repeated bending is carried out in the austenite non-recrystallization temperature region (case (2))

This case imparts brittle crack propagation stop characteristics with high toughness to the thick steel plate. Therefore, when the slab is directly rolled or is rolled after re-heating, cooling water is sprayed to the plate surface preferably at a rate of 0.05 to 2.0 $m^3/min\cdot m^2$ before the start of rolling or during rolling for at least one second, so as to cool the plate surface portion to a temperature below the $Ar_3$ point or the $Ar_1$ point. In this way, the thickness portion of at least 5% in the direction of the plate thickness is converted to the austenite-ferrite dual phases or to the ferrite single phase.

Next, while the plate surface portion is heated by the recuperative heat from inside the plate, rolling is effected for the steel plate having the texture described above at a reduction ratio of at least 20% and after rolling is completed in the texture temperature region, the temperature is raised to a temperature above the $Ac_3$ point or rolling is completed at a temperature above the $Ac_3$ point.

When rolling is carried out in the austenite-ferrite dual phase temperature region or in the ferrite single phase temperature region, the driving force of the ferrite-austenite transformation can be sufficiently increased, and then transformation is allowed to proceed to the austenite single phase. In this way, fine austenite grains having a grain size of about 10 μm at a reduction ratio of 20%, for example, can be obtained.

After the rolled material described above is obtained, repeated bending (hereinafter referred to as "leveler machining") is carried out under the same condition as in the case (1) (with the exception that the formula of the lower limit of the strain quantity is different). In other words, the strain quantity E (%) determined by the following formula (2) is imparted by leveler machining in the austenite non-recrystallization temperature region (inclusive of the austenite-ferrite non-recrystallization temperature region of the $Ar_3$ to $Ar_1$ points) above the $Ar_3$ point:

$$E \geqq 1.65 \times 10^{-3} T - 0.5 \quad (2)$$

The upper limit of the strain quantity is less than the strain quantity obtained by the formula (3) of the case (3) in the same way as in the case (1).

That is, the strain quantity is within the following range (see FIG. 3):

$$-1.14 \times 10^{-3} T + 2.4 > E \geqq 1.65 \times 10^{-3} T - 0.5$$

After the dislocation density inside the fine austenite grains is thus increased remarkably, the workpiece which is leveler-machined is cooled so as to cause the ferrite transformation. In this way, it is possible to obtain a transformation texture containing the ferrite crystal grains of below 5 μm inside the steel plate and the extremely fine ferrite crystal grains of below 1 μm in the surface portion of the steel plate.

The brittle crack propagation stop characteristics of the thick steel plate having the extremely fine ferrite crystal grain texture at the surface portion thereof can be remarkably improved, so that brittle cracks can be prevented and the product becomes extremely effective as building materials.

Cooling of the steel plate before, or during, rolling can be carried out by ordinary industrial methods such as water cooling using a spray or a laminer, water immersion cooling, cooling using a salt dissolved in other than water, and so forth, and is not particularly limited. The cooling condition cannot be determined primarily because it is affected by the plate temperature at the start of cooling, the cooling capacity (cooling rate), and so forth, but the present invention uses the cooling condition where at least 5% of the plate thickness from the surface of the steel plate to be cooled attains the metallic texture described above. For example, cooling water at a rate of 0.05 to 2.0 $m^3/min \cdot m^2$ is sprayed once or several times to the plate surface for at least one second in accordance with the plate thickness.

(3) Case where repeated bending is carried out for recrystallization in the austenite non-recrystallization temperature region (case (3))

This case imparts strong toughness and characteristics free from material anisotropy to the thick steel plate. To attain this object, rolling is carried out in the austenite non-recrystallization temperature region by applying reduction at a cumulative reduction ratio of at least 20% so as to sufficiently secure dislocation inside the austenite grains and to increase the driving force of potential recrystallization. Next, the strain quantity E (%) represented by the formula (3) is imparted subsequently in the austenite non-recrystallization temperature region (inclusive of the temperature region below the $Ar_3$ point but above the $Ar_1$ point) by effecting repeated bending (hereinafter referred to as "leveler machining"). As a result, since leveler machining is carried out in the austenite recrystallization temperature region, the fine austenite recrystallization grains can be generated in the low temperature region (see FIG. 1, case (3)).

$$E \geqq -1.14 \times 10^{-3} T + 2.4 \quad (3)$$

where

T: temperature above the $Ar_1$ point.

In other words, when the reduction quantity in the non-recrystallization temperature region is increased as in the prior art so as to increase the dislocation density as already described, material anisotropy increases, and the steel plate becomes unsuitable as a structural material.

Even when an attempt is made to make the austenite crystal grain before transformation fine by rolling in order to obtain the same effect as the increase of the dislocation density, the reduction ratio is limited from the relationship between the slab thickness before rolling and the plate thickness after rolling because the austenite grain size is determined by rolling recrystallization. Thus, there is a limit to the reduction of the grain size.

The inventors of the present invention have solved such problems by the combination of rolling and leveler machining after rolling as described above. This solution technique is based on the novel finding that the structure of dislocation inside the austenite, which is under the saturated state due to rolling in the austenite non-recrystallization temperature region, is changed and is caused to recrystallize by leveler machining which has a different machining mode from rolling.

As described above, recrystallization occurs by conducting leveler machining for imparting a specific strain quantity even in the temperature region in which austenite remains non-recrystallized by rolling, and the austenite grains having smaller grain sizes than those obtained by conventional rolling can be obtained. In consequence, material anisotropy can be eliminated, the finer ferrite grain texture can be obtain by the ferrite transformation due to cooling after leveler machining, and strong toughness can be accomplished.

(4) Case where plate surface is cooled and repeated bending is carried out in the ferrite recrystallization region (case (4))

This case imparts strong toughness and brittle crack propagation stop characteristics to the steel plate in the same way as in the case (2). To accomplish this object, the plate surface portion is cooled before, or during, rolling of the slab so as to attain the austenite-ferrite dual phase texture or the ferrite single phase texture in the same way as in the case (2), then rolling at a reduction ratio of at least 20% is carried out within the temperature region in which the ferrite is not recrystallized in the recuperative process, that is, within the temperature range of ($Ac_3$ point minus 200° C.) to the $Ac_3$ point, in order to increase the driving force of recrystallization.

Next, repeated bending (hereinafter referred to as "leveler machining") is carried out within the temperature region described above so as to impart the strain quantity E (%) (see FIG. 3) expressed by the following formula (4):

$$E \geqq -1.2 \times 10^{-3} T + 2.7 \quad (4)$$

where

T: below $Ac_3$

Figure 2:
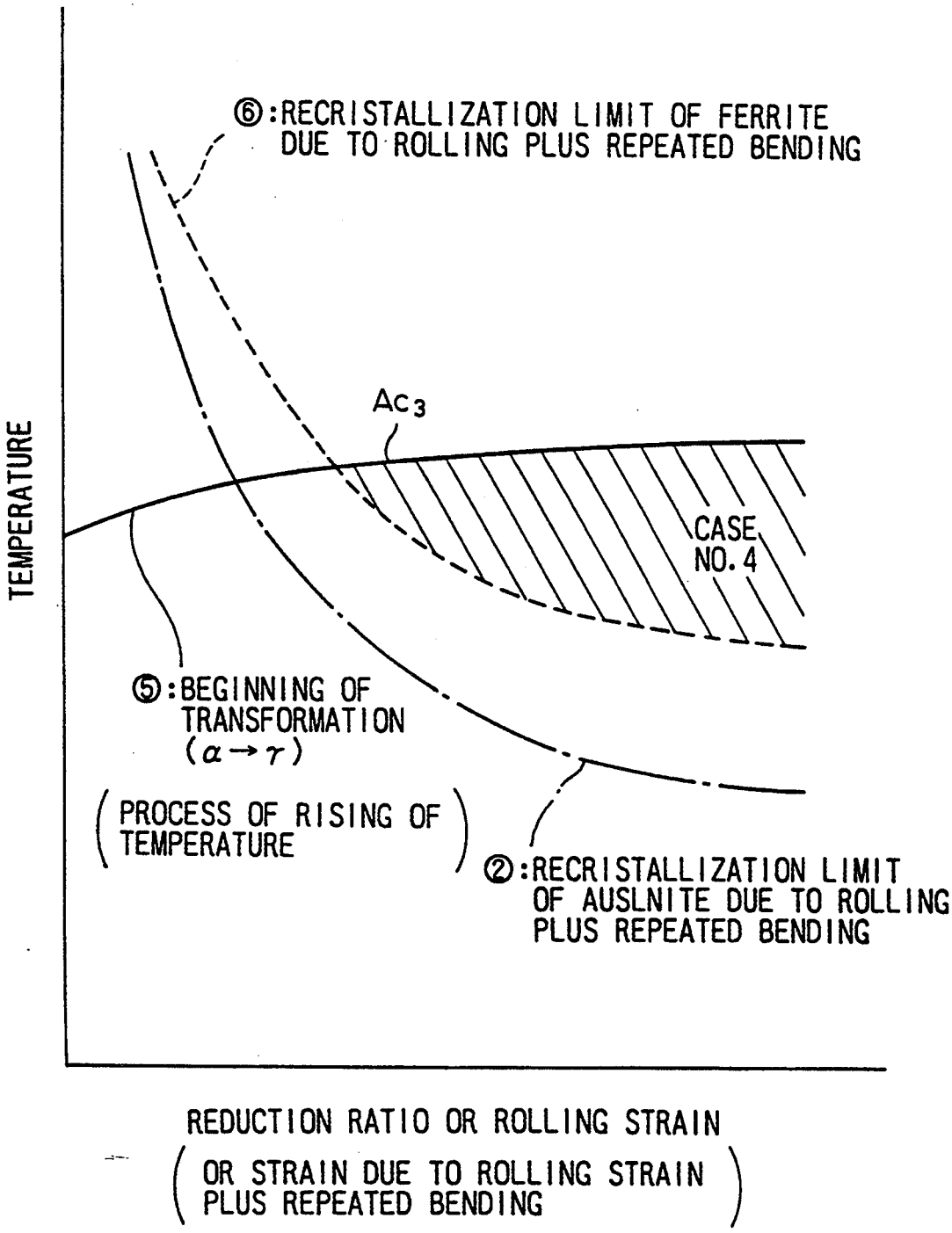
FIG. 2 schematically shows the relationship between a reduction ratio or a rolling strain (or strain due to the rolling strain plus repeated bending) and a temperature when rolling or repeated bending is applied to the slab and schematically shows a ferrite recrystallization temperature region and a transformation temperature in a temperature ascension process.

Due to this leveler machining, recrystallization occurs even in the temperature region, where the ferrite remains non-recrystallized by rolling alone, as shown in FIG. 2, and extremely fine ferrite grains can be obtained.

According to Japanese Unexamined Patent Publication (Kokai) No. 59-182916 among ther related art references described already, the temperature of the plate surface portion is high below the $Ac_3$ point. Accordingly, even when recrystallization starts occurring, abnormal grain growth is likely to occur or the texture is likely to become a mixed grain texture, and there is a limit to recrystallization of the ferrite by rolling alone. The present invention solves these problems by the combination of rolling with leveler machining so as to cause recrystallization in the low temperature region.

By the way, when the rolling finish temperature after cooling is less than ($Ac_3$ point minus 200° C.), recrystallization by subsequent repeated bending is difficult to occur and when it is above the $Ac_3$ point, on the other hand, ferrite-austenite transformation finishes during rolling, so that the ferrite is not made sufficiently fine. Therefore, the rolling finish temperature is determined to be from ($Ac_3$ point minus 200° C.) to less than the $Ac_3$ point. When the cumulative reduction ratio in the ferrite signal phase or in the ferrite/austenite dual phase region is small, the driving force of subsequent recrystallization of ferrite is not sufficient. For this reason, rolling in the ferrite single phase or the ferrite/austenite two-phase region is stipulated to be at least 20% in terms of the cumulative reduction ratio.

Next, the limitation of the components of the steel of the present invention, which is common to all the cases described above, will be explained. In the following description, the term "%" means "wt %".

Carbon (C) is an indispensable element for strengthening the steel material. If its amount is less than 0.02%, a required high strength cannot be obtained, and when the amount exceeds 0.03%, on the other hand, toughness at the weld portion is lost. Therefore, the amount is limited to from 0.02 to 0.30%.

Silicon (Si) is effective for promoting deoxidation and raising the strength. Therefore, at least 0.01% of Si is added, but when the amount is too great, weldability will drop. Therefore, the upper limit is up to 2.0%.

Manganese (Mn) is effective as an element for improving low temperature toughness, and at least 0.3% of Mn must be added. However, when its amount exceeds 3.5%, weld cracks will be promoted. Therefore, the upper limit is 3.5%.

Aluminum (Al) is effective as a deoxidizing agent and more than 0.003% of Al may be added. However, if its amount is too great, Al will form detrimental inclusions. Therefore, the upper limit is 0.1%.

Niobium (Nb) is the element which restricts rolling recrystallization of austenite even in a small amount and is effective for strengthening non-recrystallization rolling. Therefore, at least 0.001% of Nb is added, but if its amount is too great, toughness of weld joint will drop. Therefore, the upper limit is 0.1%.

When added in even a small amount, titanium (Ti) is effective for making the crystal grains fine, and at least 0.001% of Ti is therefore added, and Ti may be added in such an amount as not to deteriorate toughness of the weld portion. Therefore, the upper limit is set to 0.10%.

All of Cu, Ni, Cr, Mo, Co, and W are known elements which improve hardenability, and when added to the steel of the present invention, they can improve the strength of the steel. Therefore, at least 0.05% of these elements are added. However, when their amounts are too great, weldability will drop. Therefore, the upper limits are set to be up to 3.0% for Cu, up to 10% for Ni, up to 10% for Cr, up to 3.5% for Mo, up to 10% for Co, and up to 2% for W.

Vanadium (V) is effective for improving the strength by the precipitation effect, and at least 0.002% is added. However, the upper limit is set to 0.10% because excessive addition will deteriorate toughness.

Boron (B) is a known element which improves hardenability. When added to the steel of the present invention, B can improve the strength of the steel and at least 0.0003% is added. However, the upper limit is set to 0.0025% because excessive addition will increase the precipitation of B and will deteriorate the toughness.

Rem and Ca are effective for making S harmless. Though at least 0.002% of Rem and at least 0.0003% of Ca are added, excessive addition will deteriorate the toughness. Therefore, their limits are set to 0.10% and 0.0040%, respectively.

Since repeated bending receives alternately the tensile strain and the compressive strain, the sum of the strains which the plate surface portion receives in each of the cases described above is defined as the cumulative strain quantity which is the sum of the tensile strain and the compressive strain in the plate surface portion. In the case of bending using the leveler, the cumulative strain quantity is calculated in accordance with FIG. 4.

Figure 4:
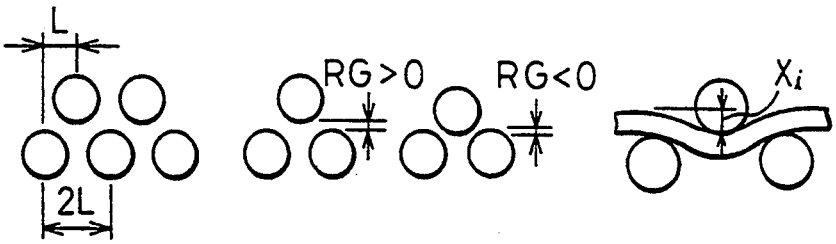
FIG. 4 shows an example of the arrangement of rolls of a leveler.

FIG. 4 shows the arrangement of the rolls of the leveler. Symbol L represents ½ of the roll gap and RG is a roll gap. Generally, L is fixed by the setup while RG is variable.

Table 1 tabulates the calculation result of the reduction quantity (push-in quantity) $X_i$ on the basis of the roll gap $RG_i$ of the i-th roll. The variable $X_i$ is determined by $RG_i$ and the plate thickness t. Table 1 represents the conditions of the maximum machining degree when the workpiece is bent along the fourth roll, but the condition of the maximum machining degree can similarly be calculated for other rolls when the workpiece is bent along other rolls by the same method. In other words, when the number of the rolls providing the maximum machining degree is imax, the reduction quantity in such a case is $X_{imax}$, the total number of rolls is N, the reduction quantity of the i-th roll is $X_i$ (the true reduction quantity (inter-mesh) mm for imparting the degree of machining $\alpha_i$ to the plate) and other symbols are defined as below, the condition providing the maximum machining degree can be determined by calculating continuously the following formulas:

$\sigma_y$: yield stress of the material (kg/mm$^2$)
L: ½ of the roll pitch (mm)
$\alpha_i$: degree of working of the i-th roll
$RG_i$: roll gap of the i-th roll (mm)
t: thickness of the plate (mm)
E: Young's modulus of the material (kg/mm$^2$)
G: shake of the leveler (0.3 mm)
A: mill spring (mm/ton)
P: correction reaction (tan)
K: coefficient (2 to 3; 3 is used)
$x_{imax}=t-RG_{imax}-G-AP$ (determined by setting $RG_{imax}$)
$X_{N-1}=\sigma_y L^2/3tE$ (calculate the reduction quantity of the last-but-one roll)

when i<imax:

$$X_i=X_{imax}+(X_{imax}-X_{N-1})/(N-1-imax)\times(imax-i)$$

when i>imax:

$$X_i = X_{imax} - (X_{imax} - X_{N-1})/(N-1-imax-)\times(i-imax)$$

$$\alpha_i = 3tE/\sigma_y L^2 \times X_i$$

with the proviso that the machining degree is 0 between the first roll and the Nth roll and 1 at the (N−1)th roll. That is, $\alpha_1 = 0$ $\alpha_N = 0$ $\alpha_{N-1} = 1$ The relation between the machining degree $\alpha_i$ and the strain $E_i$:

$$E_i = \sigma_y/E \times \alpha_i$$

The total strain quantity (corresponding to E in the formula described in the claims):

$$\Sigma E_i = \sigma_y/E \times \Sigma\alpha_i$$

TABLE 1

| Roll no. | Reduction q'ty $X_i$ | Roll gap $RG_i$ |
|---|---|---|
| 1 | $X_1 = X_4 + \frac{X_4 - X_{n-1}}{n-5} \times 3$ | $RG_i = t - X_t - G - Ap$ |
| 2 | $X_2 = X_4 + \frac{X_4 - X_{n-1}}{n-5} \times 2$ | $RG_2 = t - X_2 - G - Ap$ |
| 3 | $X_3 = X_4 + \frac{X_4 - X_{n-1}}{n-5}$ | $RG_3 = t - X_3 - G - Ap$ |
| 4 | $X_4 = \frac{\sigma_y L^2}{3t\epsilon}\alpha_4$ | $RG_4 = t - X_4 - G - Ap$ |
| | . . . | |
| i | $X_i = X_4 - \frac{X_4 - X_{n-1}}{n-5}(i-4)$ | $RG_i = t - X_i - G - Ap$ |
| | . . . | |
| n-1 | $X_{n-1} = \frac{\sigma_y L^2}{3t\epsilon} \times 1$ | $RG_{n-1} = t - X_{n-1} - G - Ap$ |
| n | $X_n = X_4 - \frac{X_4 - X_{n-1}}{n-5}(n-3)$ | $RG_n = t - X_n - G - Ap$ |

Figure 5:
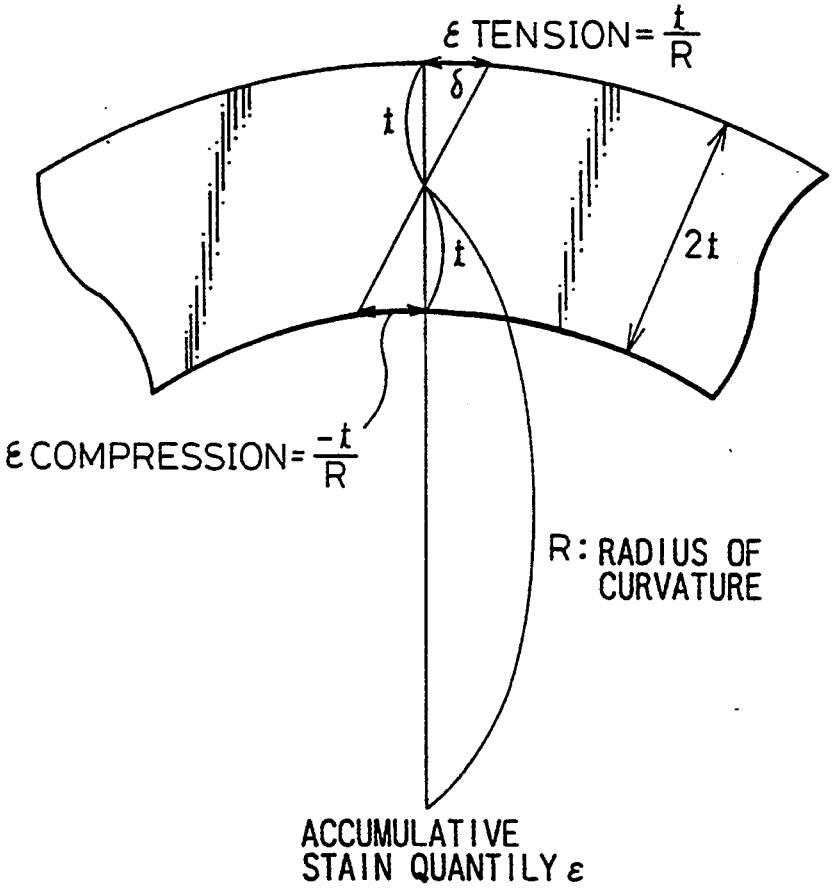
FIG. 5 shows relational factors for calculating a cumulative strain quantity when bending is applied.

The cumulative strain quantity when bending is carried out by other methods is calculated in accordance with FIG. 5. Since this machining is bending, positive and negative, opposite strains are imparted to the front and back of the plate, but because they are repeatedly imparted, the sum of the absolute values of the strains is defined as the cumulative strain quantity.

EXAMPLES

Example 1

Examples of the present invention in the case (1) described above will be explained. First of all, the method of the present invention and the comparative method shown in Tables 3(1) to 3(4) were applied to the steel of the present invention having the components shown in Table 2, and the strength and the toughness shown in Tables 3(1) to 3(4) were obtained. When comparison was made for the steels having the same components, the steels obtained by the method of the present invention exhibited an improvement in the tensile strength by at least 2 kgf/mm² and the Sharpy impact test ductile-brittle transition temperature by at least 10° C. It could be understood from these results that the steels of the present invention obviously exhibited better material characteristics and the present invention was effective. Repeated bending was carried out using the hot leveler.

By the way, the heat-treatment pattern (after rolling or after repeated bending) was as follows.

a: accelerated cooling to 500° C. at 7° C./S b: accelerated cooling to 460° C. at 14° C./S c: left for cooling d: accelerated cooling to 505° C. at 27° C./S e: direct hardening to room temperature and then tempering at 660° C.

f: accelerated cooling to room temperature at 15° C./S and then tempering at 460° C.

In each of the tensile test and the impact test, a JIS No. 4 testpiece (collected from the L direction (rolling direction) at a ¼ portion of the direction of the plate thickness) was used.

TABLE 2

| Steel No. | C | Si | Mn | Cu | Ni | Cr | Mo | Co | W | Nb | Ti | V | B | Al | Rem | Ca | Ac3 point (°C.) | (wt) % Ar3 point (°C.) |
|---|---|---|---|---|---|---|---|---|---|---|---|---|---|---|---|---|---|---|
| A | 0.08 | 0.24 | 1.33 | 0.12 | 0.40 | — | — | — | — | 0.005 | 0.007 | 0.004 | — | 0.025 | — | 0.0020 | 858 | 754 |
| B | 0.15 | 0.18 | 1.10 | — | — | — | — | — | — | — | 0.007 | 0.004 | — | 0.030 | 0.01 | — | 840 | 776 |
| C | 0.05 | 0.26 | 1.55 | — | — | — | — | — | — | 0.045 | 0.022 | — | 0.0011 | 0.030 | — | 0.0030 | 876 | 771 |
| D | 0.04 | 0.29 | 0.72 | 0.41 | 0.14 | 0.55 | — | — | — | 0.020 | — | — | — | 0.025 | — | — | 880 | 816 |

TABLE 2-continued

| Steel No. | C | Si | Mn | Cu | Ni | Cr | Mo | Co | W | Nb | Ti | V | B | Al | Rem | Ca | $Ac_3$ point (°C.) | (wt) % $Ar_3$ point (°C.) |
|---|---|---|---|---|---|---|---|---|---|---|---|---|---|---|---|---|---|---|
| E | 0.22 | 0.06 | 0.33 | — | — | — | — | — | — | — | — | — | — | 0.007 | — | — | 817 | 815 |
| F | 0.10 | 0.20 | 1.00 | 0.61 | 0.89 | 0.30 | 0.30 | — | — | — | — | 0.046 | 0.0009 | 0.069 | — | 0.0020 | 855 | 709 |
| G | 0.11 | 0.16 | 0.30 | — | 9.9 | 5.8 | 0.90 | 8.8 | 0.1 | — | — | — | — | 0.005 | — | — | 728 | 600 or below |
| H | 0.05 | 1.05 | 0.30 | 1.33 | 1.72 | 0.40 | 0.50 | — | — | 0.025 | 0.009 | — | 0.0008 | 0.077 | — | — | 901 | 703 |
| I | 0.07 | 0.26 | 1.72 | — | — | — | — | — | — | — | 0.018 | — | — | 0.025 | — | — | 868 | 751 |
| J | 0.08 | 0.25 | 1.71 | — | — | — | — | — | — | 0.014 | — | — | — | 0.027 | — | — | 864 | 748 |
| K | 0.12 | 0.26 | 1.31 | — | — | — | — | — | — | — | — | 0.042 | — | 0.018 | — | — | 856 | 768 |
| L | 0.11 | 0.28 | 1.21 | — | — | — | — | — | — | — | — | — | 0.0011 | 0.027 | 0.05 | — | 855 | 779 |
| M | 0.12 | 0.33 | 1.06 | — | — | 0.45 | — | — | — | — | 0.011 | — | — | 0.035 | — | — | 854 | 781 |

TABLE 3(1)

| No. | Steel No. | Classification | Slab history | Rolling finish temp. (°C.) | Reduction ratio in non-recrystallization temp. region (%) | Start temp. of repeated bending (°C.) | Sum of strains imparted to plate surface portion by repeated bending | Plate thickness (mm) | Heat treatment | Mechanical properties: Tensile strength (kgf/mm²) | Yield strength (kgf/mm²) | Ductile-brittle transition temp. (°C.) |
|---|---|---|---|---|---|---|---|---|---|---|---|---|
| 1 | A | Invention | Re-heating rolling | 910 | 0 | 775 | 1.2 | 60 | a | 54 | 40 | −81 |
| 2 | A | Invention | Re-heating rolling | 786 | 50 | 771 | 2.6 | 60 | a | 53 | 41 | −106 |
| 3 | A | Comp. example | Re-heating rolling | 791 | 50 | nil | nil | 60 | a | 51 | 38 | −66 |
| 4 | A | Comp. example | Re-heating rolling | 915 | 0 | nil | nil | 60 | a | 51 | 38 | −62 |
| 5 | B | Invention | Re-heating rolling | 785 | 65 | 770 | 2.4 | 30 | b | 57 | 40 | −105 |
| 6 | C | Invention | Re-heating rolling | 905 | 22 | 894 | 1.5 | 28 | c | 63 | 46 | −100 |
| 7 | C | Comp. example | Re-heating rolling | 911 | 25 | 890 | 0.9 | 28 | c | 61 | 41 | −82 |
| 8 | D | Invention | Re-heating rolling | 853 | 70 | 832 | 2.6 | 18 | d | 62 | 50 | −76 |
| 9 | D | Comp. example | Re-heating rolling | 850 | 70 | nil | nil | 18 | d | 60 | 46 | −61 |

NOTE:
Underline represents a value other than the value of this invention.

TABLE 3(2)

| No. | Steel No. | Classification | Slab history | Rolling finish temp. (°C.) | Reduction ratio in non-recrystallization temp. region (%) | Start temp. of repeated bending (°C.) | Sum of strains imparted to plate surface portion by repeated bending | Plate thickness (mm) | Heat treatment | Mechanical properties: Tensile strength (kgf/mm²) | Yield strength (kgf/mm²) | Ductile-brittle transition temp. (°C.) |
|---|---|---|---|---|---|---|---|---|---|---|---|---|
| 10 | B | Comp. example | Re-heating rolling | 781 | 65 | nil | nil | 30 | b | 55 | 37 | −90 |
| 11 | E | Invention | Re-heating rolling | 865 | 0 | 765 | 4.2 | 30 | c | 48 | 34 | −15 |
| 12 | E | Comp. example | Re-heating rolling | 854 | 0 | nil | nil | 30 | c | 46 | 32 | +20 |
| 13 | F | Invention | Re-heating rolling | 790 | 50 | 779 | 1.2 | 25 | e | 90 | 82 | −119 |
| 14 | F | Invention | Re-heating rolling | 786 | 50 | 771 | 3.3 | 25 | e | 92 | 86 | −126 |
| 15 | F | Comp. example | Re-heating rolling | 788 | 50 | nil | nil | 25 | e | 87 | 79 | −88 |
| 16 | H | Invention | Re-heating rolling | 950 | 0 | 772 | 1.5 | 20 | e | 81 | 77 | −135 |
| 17 | H | Comp. example | Re-heating rolling | 950 | 0 | nil | nil | 20 | e | 76 | 69 | −113 |
| 18 | H | Invention | Direct rolling | 936 | 0 | 785 | 3.3 | 20 | e | 83 | 80 | −140 |

TABLE 3(3)

| No. | Steel No. | Classification | Slab history | Rolling finish temp. (°C.) | Reduction ratio in non-recrystallization temp. region (%) | Start temp. of repeated bending (°C.) | Sum of strains imparted to plate surface portion by repeated bending | Plate thickness (mm) | Heat treatment | Mechanical properties: Tensile strength (kgf/mm²) | Yield strength (kgf/mm²) | Ductile-brittle transition temp. (°C.) |
|---|---|---|---|---|---|---|---|---|---|---|---|---|
| 19 | G | Invention | Re-heating rolling | 785 | 20 | 771 | 1.6 | 20 | f | 160 | 140 | −71 |
| 20 | G | Comp. Example | Re-heating rolling | 772 | 40 | nil | nil | 20 | f | 158 | 137 | −55 |
| 21 | H | Invention | Direct rolling | 775 | 50 | 765 | 2.3 | 20 | e | 88 | 84 | −150 |
| 22 | H | Comp. example | Direct rolling | 769 | 50 | nil | nil | 20 | e | 86 | 81 | −118 |
| 23 | I | Invention | Re-heating rolling | 790 | 50 | 778 | 2.1 | 40 | b | 60 | 46 | −96 |
| 24 | I | Comp. example | Re-heating rolling | 795 | 50 | nil | nil | 40 | b | 58 | 42 | −76 |
| 25 | J | Invention | Re-heating rolling | 806 | 66 | 794 | 1.8 | 18 | d | 68 | 51 | −89 |
| 26 | J | Comp. example | Re-heating rolling | 818 | 66 | nil | nil | 18 | d | 65 | 48 | −69 |
| 27 | K | Invention | Re-heating rolling | 791 | 50 | 783 | 2.5 | 30 | b | 61 | 47 | −73 |

TABLE 3(4)

| No. | Steel No. | Classification | Slab history | Rolling finish temp. (°C.) | Reduction ratio in non-recrystallization temp. region (%) | Start temp. of repeated bending (°C.) | Sum of strains imparted to plate surface portion by repeated bending | Plate thickness (mm) | Heat treatment | Mechanical properties: Tensile strength (kgf/mm²) | Yield strength (kgf/mm²) | Ductile-brittle transition temp. (°C.) |
|---|---|---|---|---|---|---|---|---|---|---|---|---|
| 28 | K | Comp. example | Re-heating rolling | 795 | 50 | nil | nil | 30 | b | 59 | 45 | −58 |
| 29 | L | Invention | Re-heating rolling | 806 | 40 | 791 | 1.9 | 25 | e | 65 | 59 | −115 |
| 30 | L | Comp. example | Re-heating rolling | 800 | 40 | nil | nil | 25 | e | 61 | 55 | −73 |
| 31 | M | Invention | Re-heating rolling | 795 | 60 | 788 | 2.1 | 12 | e | 68 | 62 | −115 |
| 32 | M | Comp. example | Re-heating rolling | 795 | 60 | nil | nil | 12 | e | 65 | 57 | −89 |
| 33 | A | Comp. example | Re-heating rolling | 790 | 50 | 690 | 0.5 | 60 | a | 52 | 39 | −70 |
| 34 | C | Comp. example | Re-heating rolling | 910 | 0 | 901 | 0.9 | 28 | c | 61 | 42 | −80 |
| 35 | C | Invention | Re-heating rolling | 906 | 0 | 900 | 1.2 | 28 | c | 63 | 46 | −101 |

Example 2

Examples of the present invention in the case (2) will be explained.

The method of the present invention and the comparative method shown in Table 4 were applied to the steels of the present invention having the components shown in Table 2, and the strength, the toughness, and the Kca value shown in Tables 4(1) to 4(4) were obtained. Here, the Kca value was measured by a temperature gradient type ESSO test (refer, for example, to H. Kihara "Brittle Breakdown 2", Baifukan, p.41). When the results in Tables 4(1) to 4(4) were put in order by the thick steel plates having the same components and the same plate thickness at the same test temperature, it could be understood that the Kca value of the steels of the present invention was improved by at least 100 kgf/mm$^{1.5}$, the strength of the base metal remained substantially equivalent or more, and the ductile-brittle transition temperature was improved by at least 10° C. It could be understood from Table 4 that the steels of the present invention obviously exhibited better material characteristics and the present invention was effective. Repeated bending was carried out using a hot leveler.

By the way, the heat-treatment pattern (after rolling or after repeated bending) was the same as that of Example 1.

TABLE 4(1)

| Plate No. | Steel No. | | Slab history | Plate thickness at start of water cooling (mm) | Cumulative reduction ratio in α single phase or γ/α dual phase temp. region (%) | Proportion cooled to α single phase or γ/α dual phase temp. region (one side) (%) | Rolling finish temp. (°C.) | Finish temp. of repeated bending (°C.) |
|---|---|---|---|---|---|---|---|---|
| 1 | A | Inv. | Re-heating rolling | 190 | 86.8 | 10 | 860 | 849 |
| 2 | A | Inv. | Re-heating rolling | 40 | 37.5 | 8 | 863 | 851 |
| 3 | A | Comp. Ex. | Re-heating rolling | nil | nil | 0 | 801 | 792 |
| 4 | A | Comp. Ex. | Re-heating rolling | 190 | 86.8 | 10 | 860 | nil |
| 5 | B | Inv. | Re-heating rolling | 40 | 25.0 | 9 | 845 | 786 |
| 6 | B | Comp. Ex. | Re-heating rolling | nil | nil | 0 | 845 | 790 |
| 7 | C | Inv. | Re-heating rolling | 150 | 89.3 | 11 | 880 | 811 |
| 8 | C | Comp. Ex. | Re-heating rolling | 150 | 89.3 | 11 | 855 | 804 |
| 9 | D | Inv. | Re-heating rolling | 40 | 55.0 | 7 | 885 | 869 |
| 10 | D | Comp. Ex. | Re-heating rolling | 40 | 55.0 | 7 | 885 | 868 |
| 11 | E | Inv. | Re-heating rolling | 50 | 40 | 8 | 820 | 816 |
| 12 | E | Comp. Ex. | Re-heating rolling | 35 | 16.7 | 7 | 825 | 811 |
| 13 | F | Inv. | Re-heating rolling | 120 | 66.7 | 18 | 860 | 765 |
| 14 | F | Comp. Ex. | Re-heating rolling | 120 | 66.7 | 17 | 858 | nil |
| 15 | F | Inv. | Direct rolling | 80 | 37.5 | 10 | 865 | 850 |
| 16 | F | Comp. Ex. | Direct rolling | nil | nil | 0 | 775 | 771 |
| 17 | G | Inv. | Re-heating rolling | 120 | 73.3 | 21 | 730 | 716 |
| 18 | G | Comp. Ex. | Re-heating rolling | nil | nil | 0 | 755 | 739 |

Note:
Inv.: Invention, Comp. Ex.; Comparative example
(1) JIS No. 4 testpiece was used for both tensile test and impact test (¼t - L direction).
(2) Temperature gradient type ESSO test was used for arrest test.

TABLE 4(2)

| Plate No. | Steel No. | | Sum of strains imparted to plate surface portion by repeated bending | Plate thickness (mm) | Heat-treatment pattern | Mechanical properties: Tensile strength (kgf/mm²) | Ductile-brittle transition temp. (°C.) | Kca value (kgf/mm^1.5) | Temp. exhibiting Kca value (°C.) |
|---|---|---|---|---|---|---|---|---|---|
| 1 | A | | 1.1 | 25 | d | 56 | −105 | 670 | −80 |
| 2 | A | | 1.0 | 25 | d | 55 | −100 | 660 | −80 |
| 3 | A | Comp. | 1.3 | 25 | d | 53 | −85 | 280 | −80 |
| 4 | A | Comp. | nil | 25 | d | 52 | −90 | 360 | −80 |
| 5 | B | | 6.5 | 30 | b | 55 | −100 | 510 | −40 |
| 6 | B | Comp. | 6.5 | 30 | b | 53 | −85 | 300 | −40 |
| 7 | C | | 3.1 | 16 | c | 59 | −95 | 650 | −60 |
| 8 | C | Comp. | 3.1 | 16 | c | 58 | −60 | 350 | −60 |
| 9 | D | | 1.3 | 18 | d | 61 | −90 | 640 | −80 |
| 10 | D | Comp. | 0.8 | 18 | d | 59 | −65 | 460 | −80 |
| 11 | E | | 2.5 | 30 | c | 47 | −20 | 250 | −20 |
| 12 | E | Comp. | 2.5 | 30 | c | 45 | +15 | 120 | −20 |
| 13 | F | | 3.5 | 50 | e | 93 | −105 | 550 | −40 |
| 14 | F | Comp. | nil | 50 | e | 92 | −91 | 450 | −40 |
| 15 | F | | 2.5 | 50 | c | 94 | −85 | 510 | −40 |
| 16 | F | Comp. | 2.4 | 50 | e | 92 | −50 | 280 | −40 |
| 17 | G | | 3.8 | 30 | f | 151 | −72 | 680 | −196 |
| 18 | G | Comp. | 3.5 | 30 | f | 146 | −36 | 490 | −196 |

Notes:
(1) JIS No. 4 testpiece was used for both tensile test and impact test (¼t - L direction).
(2) Temperature gradient type ESSO test was used for arrest test.

TABLE 4(3)

| Plate No. | Steel No. | | Slab history | Plate thickness at start of water cooling (mm) | Cumulative reduction ratio in α single phase or γ/α dual phase temp. region (%) | Proportion cooled to α single phase or γσ/α dual phase temp. region (one side) (%) | Rolling finish temp. (°C.) | Finish temp. of repeated bending (°C.) |
|---|---|---|---|---|---|---|---|---|
| 19 | H | | Re-heating rolling | 40 | 50.0 | 8 | 910 | 898 |
| 20 | H | Comp. | Re-heating rolling | 40 | 50.0 | 9 | 905 | nil |
| 21 | H | | Re-heating rolling | 120 | 83.3 | 11 | 910 | 896 |
| 22 | H | Comp. | Re-heating rolling | 120 | 83.3 | 13 | 870 | 858 |
| 23 | I | | Re-heating rolling | 120 | 66.7 | 10 | 870 | 860 |
| 24 | I | Comp. | Re-heating rolling | 120 | 66.7 | 10 | 871 | 862 |
| 25 | J | | Re-heating rolling | 80 | 77.5 | 7 | 870 | 860 |

TABLE 4(3)-continued

| Plate No. | Steel No. | | Slab history | Plate thickness at start of water cooling (mm) | Cumulative reduction ratio in α single phase or γ/α dual phase temp. region (%) | Proportion cooled to α single phase or γσ/α dual phase temp. region (one side) (%) | Rolling finish temp. (°C.) | Finish temp. of repeated bending (°C.) |
|---|---|---|---|---|---|---|---|---|
| 26 | J | Comp. | Re-heating rolling | 80 | 77.5 | 7 | 872 | nil |
| 27 | K | | Re-heating rolling | 120 | 75.0 | 9 | 862 | 791 |
| 28 | K | Comp. | Re-heating rolling | nil | nil | 0 | 775 | nil |
| 29 | L | | Re-heating rolling | 40 | 37.5 | 9 | 860 | 849 |
| 30 | L | Comp. | Re-heating rolling | 30 | 16.7 | 6 | 860 | 750 |
| 31 | M | | Re-heating rolling | 40 | 70.0 | 9 | 860 | 810 |
| 32 | M | Comp. | Re-heating rolling | nil | nil | 0 | 861 | 806 |
| 33 | M | Comp. | Re-heating rolling | 40 | 40.0 | 4 | 858 | 835 |
| 34 | M | Comp. | Re-heating rolling | 40 | 70.0 | 10 | 857 | 760 |

Notes
(1) JIS No. 4 testpiece was used for both tensile test and impact test (¼t - L direction).
(2) Temperature gradient type ESSO test was used for arrest test.

TABLE 4(4)

| Plate No. | Steel No. | | Sum of strains imparted to plate surface portion by repeated bending | Plate thickness (mm) | Heat-treatment pattern | Mechanical properties: Tensile strength (kgf/mm²) | Ductile-brittle transition temp. (°C.) | Kca value (kgf/mm^1.5) | Temp. exhibiting Kca value (°C.) |
|---|---|---|---|---|---|---|---|---|---|
| 19 | H | | 3.3 | 20 | e | 90 | −155 | 680 | −100 |
| 20 | H | Comp. | nil | 20 | e | 88 | −130 | 480 | −100 |
| 21 | H | | 1.4 | 20 | e | 91 | −160 | 700 | −100 |
| 22 | H | Comp. | 1.1 | 20 | e | 92 | −110 | 420 | −100 |
| 23 | I | | 1.8 | 40 | b | 59 | −93 | 470 | −40 |
| 24 | I | Comp. | 0.6 | 40 | b | 56 | −64 | 290 | −40 |
| 25 | J | | 2.1 | 18 | d | 66 | −85 | 660 | −80 |
| 26 | J | Comp. | nil | 18 | d | 64 | −60 | 310 | −80 |
| 27 | K | | 2.2 | 30 | b | 61 | −70 | 390 | −40 |
| 28 | K | Comp. | nil | 30 | b | 60 | −60 | 240 | −40 |
| 29 | L | | 2.1 | 25 | e | 61 | −95 | 510 | −80 |
| 30 | L | Comp. | 0.5 | 25 | e | 58 | −70 | 240 | −80 |
| 31 | M | | 2.4 | 12 | e | 65 | −100 | 650 | −80 |
| 32 | M | Comp. | 2.4 | 12 | e | 62 | −80 | 320 | −80 |
| 33 | M | Comp. | 2.4 | 12 | e | 63 | −81 | 400 | −80 |
| 34 | M | Comp. | 3.3 | 12 | e | 63 | −58 | 500 | −80 |

Notes
(1) JIS No. 4 testpiece was used for both tensile test and impact test (¼t - L direction).
(2) Temperature gradient type ESSO test was used for arrest test.

Example 3

Examples of the present invention in the case (3) will be explained.

When the method of the present invention and the comparative method shown in Tables 5(1) to 5(4) were applied to the steels of the present invention having the components shown in Table 2, the strength and the toughness shown in Tables 5(1) to 5(4) were obtained. When comparison was made by the steels having the same components, it was found that the difference of the tensile strength in the L direction/T direction of the steels of the present invention was within 1 kgf/mm² and the ductile-brittle transition temperature of the Sharpy impact test was within 3° C. There could thus be obtained the thick steel plates having extremely small material anisotropy. No. 2 of this example represents the case where non-recrystallization temperature region rolling was not carried out. For this reason, material anisotropy was small, but the ductile brittle transition temperature of the Sharpy impact test was deteriorated by about 50° C. in comparison with the steel No. 3 of the present invention. It could be understood from these results that the steels of the present invention obviously exhibited excellent material characteristics devoid of material anisotropy, and the present invention was effective. Repeated bending was carried out using a hot leveler.

By the way, the heat-treatment pattern (after rolling or after repeated bending) in the table was the same as that of Example 1.

TABLE 5(1)

| Classification | No. | Steel No. | Slab history | Reduction ratio in non-crystallization temp. region (%) | Rolling finish temp. (°C.) | Start temp. of repeated bending (°C.) | Sum of strains imparted to plate surface portion by repeated bending | Plate thickness (mm) | Heat-treatment | Mechanical properties (L direction) Tensile strength (kgf/mm²) | Mechanical properties (L direction) Ductile-brittle transition temp. (°C.) | Mechanical properties (T direction) Tensile strength (kgf/mm²) | Mechanical properties (T direction) Ductile-brittle transition temp. (°C.) |
|---|---|---|---|---|---|---|---|---|---|---|---|---|---|
| Comp. steel | 1 | A | Re-heating rolling | 40 | 785 | nil | nil | 60 | a | 54 | −108 | 51 | −71 |
| Comp. steel | 2 | A | Re-heating rolling | -0 | 915 | 775 | 1.9 | 60 | a | 54 | −66 | 53 | −62 |
| Steel of Inv. | 3 | A | Re-heating rolling | 40 | 801 | 780 | 4.2 | 60 | a | 55 | −115 | 55 | −115 |
| Steel of Inv. | 4 | A | Direct rolling | 50 | 770 | 765 | 3.5 | 60 | a | 57 | −92 | 56 | −91 |
| Steel of Inv. | 5 | B | Re-heating rolling | 67 | 780 | 766 | 3.5 | 30 | b | 58 | −106 | 58 | −106 |
| Comp steel | 6 | B | Re-heating rolling | 67 | 782 | nil | nil | 30 | b | 57 | −110 | 53 | −81 |
| Steel of Inv. | 7 | C | Re-heating rolling | 25 | 801 | 790 | 3.5 | 28 | c | 64 | −101 | 64 | −100 |
| Comp. steel | 8 | C | Re-heating rolling | 25 | 800 | 790 | 1.0 | 28 | c | 65 | −106 | 62 | −71 |
| Steel of Inv. | 9 | D | Re-heating rolling | 70 | 845 | 821 | 7.5 | 18 | d | 60 | −77 | 61 | −75 |

TABLE 5(2)

| Classification | No. | Steel No. | Slab history | Reduction ratio in non-crystallization temp. region (%) | Rolling finish temp. (°C.) | Start temp. of repeated bending (°C.) | Sum of strains imparted to plate surface portion by repeated bending | Plate thickness (mm) | Heat-treatment | Mechanical properties (L direction) Tensile strength (kgf/mm²) | Mechanical properties (L direction) Ductile-brittle transition temp. (°C.) | Mechanical properties (T direction) Tensile strength (kgf/mm²) | Mechanical properties (T direction) Ductile-brittle transition temp. (°C.) |
|---|---|---|---|---|---|---|---|---|---|---|---|---|---|
| Comp. steel | 10 | D | Re-heating rolling | 70 | 851 | nil | nil | 18 | d | 62 | −76 | 58 | −48 |
| Steel of Inv. | 11 | E | Re-heating rolling | 40 | 796 | 780 | 4.1 | 30 | c | 48 | −30 | 47 | −30 |
| Comp. steel | 12 | E | Re-heating rolling | 40 | 789 | 775 | 1.1 | 30 | c | 47 | −22 | 44 | +10 |
| Steel of Inv. | 13 | F | Re-heating rolling | 50 | 770 | 758 | 2.8 | 25 | e | 90 | −125 | 90 | −123 |
| Comp. steel | 14 | F | Re-heating rolling | 10 | 775 | 765 | 2.8 | 25 | e | 88 | −108 | 85 | −84 |
| Comp. steel | 15 | F | Re-heating rolling | 50 | 772 | nil | nil | 25 | e | 90 | −120 | 88 | −88 |
| Steel of Inv. | 16 | G | Re-heating rolling | 20 | 785 | 771 | 4.6 | 20 | f | 160 | −72 | 160 | −72 |
| Comp. steel | 17 | G | Re-heating rolling | 0 | 950 | 720 | 3.3 | 20 | f | 148 | −51 | 145 | −50 |
| Steel of Inv. | 18 | H | Re-heating rolling | 50 | 825 | 812 | 2.1 | 20 | e | 91 | −165 | 90 | −163 |

TABLE 5(3)

| Classification | No. | Steel No. | Slab history | Reduction ratio in non-crystallization temp. region (%) | Rolling finish temp. (°C.) | Start temp. of repeated bending (°C.) | Sum of strains imparted to plate surface portion by repeated bending | Plate thickness (mm) | Heat-treatment | Mechanical properties (L direction) Tensile strength (kgf/mm²) | Mechanical properties (L direction) Ductile-brittle transition temp. (°C.) | Mechanical properties (T direction) Tensile strength (kgf/mm²) | Mechanical properties (T direction) Ductile-brittle transition temp. (°C.) |
|---|---|---|---|---|---|---|---|---|---|---|---|---|---|
| Steel of Inv. | 19 | H | Re-heating rolling | 50 | 820 | 810 | 5.1 | 20 | c | 91 | −161 | 91 | −163 |
| Comp. steel | 20 | H | Re-heating rolling | 50 | 816 | nil | nil | 20 | e | 90 | −155 | 88 | −112 |
| Steel of Inv. | 21 | I | Re-heating rolling | 40 | 785 | 776 | 3.5 | 30 | b | 61 | −97 | 62 | −95 |
| Comp. | 22 | I | Re-heating | 40 | 779 | nil | nil | 30 | b | 60 | −94 | 58 | −72 |

TABLE 5(3)-continued

| Classification | No. | Steel No. | Slab history | Reduction ratio in non-crystallization temp. region (%) | Rolling finish temp. (°C.) | Start temp. of repeated bending (°C.) | Sum of strains imparted to plate surface portion by repeated bending | Plate thickness (mm) | Heat-treatment | Mechanical properties (L direction) Tensile strength (kgf/mm²) | Mechanical properties (L direction) Ductile-brittle transition temp. (°C.) | Mechanical properties (T direction) Tensile strength (kgf/mm²) | Mechanical properties (T direction) Ductile-brittle transition temp. (°C.) |
|---|---|---|---|---|---|---|---|---|---|---|---|---|---|
| steel | | | rolling | | | | | | | | | | |
| Steel of Inv. | 23 | J | Re-heating rolling | 60 | 815 | 808 | 2.1 | 20 | d | 65 | −75 | 65 | −73 |
| Comp steel | 24 | J | Re-heating rolling | 60 | 812 | nil | nil | 20 | d | 64 | −66 | 62 | −38 |
| Steel of Inv. | 25 | K | Re-heating rolling | 50 | 790 | 776 | 1.7 | 30 | b | 60 | −72 | 60 | −72 |
| Comp. steel | 26 | K | Re-heating rolling | 50 | 792 | nil | nil | 30 | b | 57 | −60 | 55 | −40 |
| Steel of Inv. | 27 | L | Re-heating rolling | 40 | 802 | 791 | 3.4 | 25 | e | 64 | −105 | 63 | −103 |

TABLE 5(4)

| Classification | No. | Steel No. | Slab history | Reduction ratio in non-crystallization temp. region (%) | Rolling finish temp. (°C.) | Start temp. of repeated bending (°C.) | Sum of strains imparted to plate surface portion by repeated bending | Plate thickness (mm) | Heat-treatment | Mechanical properties (L direction) Tensile strength (kgf/mm²) | Mechanical properties (L direction) Ductile-brittle transition temp. (°C.) | Mechanical properties (T direction) Tensile strength (kgf/mm²) | Mechanical properties (T direction) Ductile-brittle transition temp. (°C.) |
|---|---|---|---|---|---|---|---|---|---|---|---|---|---|
| Comp. steel | 28 | L | Re-heating rolling | 40 | 798 | 789 | 0.5 | 25 | e | 62 | −98 | 60 | −71 |
| Steel of Inv. | 29 | M | Re-heating rolling | 60 | 795 | 780 | 3.3 | 12 | e | 69 | −105 | 68 | −102 |
| Comp. steel | 30 | M | Re-heating rolling | 60 | 795 | nil | nil | 12 | e | 66 | −90 | 63 | −68 |

Example 4

Examples of the present invention in the case (4) will be explained.

When the method of the present invention and the Comparative method shown in Tables 6(1) and 6(2) were applied to the steels of the present invention shown in Table 2, the strength, the toughness, and the Kca values shown in Tables 6(1) and 6(2) were obtained. Here, the Kca value was measured by the temperature gradient type ESSO test in the same way as in Example 2.

When Tables 6(1) and 6(2) were put in order by the thick steel plates having the same components and the same plate thickness at the same test temperature, it was found out that the Kca value was improved by at least 100 $mm^{1.5}$, the strength of the base metal remained substantially equivalent, and the-ductile-brittle transition temperature, too, was improved by at least 10° C. It could be understood from Tables 6(1) to 6(2) that the steels of the present invention obviously exhibited better material characteristics and the present invention was effective. Repeated bending was carried out using the hot leveler.

By the way, the heat-treatment pattern (after rolling or after repeating bending) in the table was the same as that of Example 1.

TABLE 6(1)

| Plate No. | Steel No. | Classification | Slab history | Plate thickness at start of water cooling (mm) | Cumulative reduction ratio in α single phase or γ/α dual phase temp. region (%) | Proportion cooled to α single phase or γ/α dual phase temp. region (one side) (%) | Rolling finish temp. (°C.) | Start temp. of repeated bending (°C.) |
|---|---|---|---|---|---|---|---|---|
| 1 | A | | Re-heating rolling | 200 | 87.5 | 18 | 815 | 806 |
| 2 | A | | Re-heating rolling | 40 | 37.5 | 30 | 715 | 712 |
| 3 | A | Comp. | Re-heating rolling | nil | | 0 | 796 | 785 |
| 4 | A | Comp. | Re-heating rolling | 200 | 87.5 | 20 | 810 | nil |
| 5 | A | Comp. | Re-heating rolling | nil | | 0 | 785 | nil |
| 6 | B | | Re-heating rolling | 40 | 25.0 | 20 | 775 | 765 |
| 7 | B | Comp. | Re-heating rolling | nil | | 0 | 790 | nil |
| 8 | C | | Re-heating rolling | 150 | 89.3 | 7 | 875 | 865 |
| 9 | C | Comp. | Re-heating rolling | nil | | 0 | 855 | 842 |
| 10 | D | | Re-heating rolling | 40 | 55 | 30 | 717 | 712 |
| 11 | D | Comp. | Re-heating rolling | 40 | 55 | 30 | 715 | 711 |

TABLE 6(1)-continued

| Plate No. | Steel No. | Classification | Slab history | Plate thickness at start of water cooling (mm) | Cumulative reduction ratio in α single phase or γ/α dual phase temp. region (%) | Proportion cooled to α single phase or γ/α dual phase temp. region (one side) (%) | Rolling finish temp. (°C.) | Start temp. of repeated bending (°C.) |
|---|---|---|---|---|---|---|---|---|
| 12 | E | | Re-heating rolling | 50 | 40 | 20 | 780 | 771 |
| 13 | E | Comp. | Re-heating rolling | 35 | 16.7 | 22 | 768 | 760 |
| 14 | E | | Direct rolling | 120 | 75.0 | 34 | 688 | 685 |
| 15 | E | Comp. | Direct rolling | | nil | 0 | 796 | nil |
| 16 | F | | Re-heating rolling | 120 | 66.7 | 25 | 755 | 750 |
| 17 | F | Comp. | Re-heating rolling | 120 | 66.7 | 27 | 736 | nil |
| 18 | F | | Re-heating rolling | 80 | 37.5 | 33 | 696 | 695 |
| 19 | G | | Re-heating rolling | 120 | 73.3 | 24 | 650 | 648 |
| 20 | G | Comp. | Re-heating rolling | | nil | nil | 661 | nil |
| 21 | H | | Re-heating rolling | 40 | 50 | 20 | 850 | 832 |
| 22 | H | Comp. | Re-heating rolling | 40 | 50 | 20 | 849 | 835 |
| 23 | H | Comp. | Re-heating rolling | | nil | nil | 851 | nil |
| 24 | I | | Re-heating rolling | 120 | 66.7 | 16 | 840 | 831 |
| 25 | I | Comp. | Re-heating rolling | 120 | 66.7 | 6 | 870 | 864 |
| 26 | J | | Re-heating rolling | 80 | 77.5 | 24 | 805 | 792 |
| 27 | J | Comp. | Re-heating rolling | 80 | 77.5 | 25 | 800 | nil |
| 28 | K | | Re-heating rolling | 120 | 75.0 | 18 | 815 | 802 |
| 29 | K | Comp. | Re-heating rolling | | nil | nil | 775 | nil |
| 30 | L | | Re-heating rolling | 40 | 37.5 | 10 | 815 | 803 |
| 31 | L | Comp. | Re-heating rolling | 30 | 16.7 | 4 | 767 | 760 |
| 32 | M | | Re-heating rolling | 40 | 70.0 | 28 | 850 | 841 |
| 33 | M | Comp. | Re-heating rolling | 40 | 25.0 | 4 | 850 | 839 |

Notes
(1) JIS No. 4 testpiece was used for both tensile test and impact test (¼t - L direction).
(2) Temperature gradient type ESSO test was used for arrest test.

TABLE 6(2)

| Plate No. | Steel No. | Sum of strains imparted to plate surface portion by repeated bending | Plate thickness (mm) | Heat-treatment pattern | Mechanical properties: Tensile strength (kgf/mm²) | Ductile-brittle transition temp. (°C.) | Kca value (kgf/mm^1.5) | Temp. exhibiting Kca value (°C.) |
|---|---|---|---|---|---|---|---|---|
| 1 | A | 1.9 | 25 | d | 57 | −110 | 690 | −80 |
| 2 | A | 3.2 | 25 | d | 56 | −100 | 670 | −80 |
| 3 | A | 2.8 | 25 | d | 53 | −88 | 360 | −80 |
| 4 | A | nil | 25 | d | 52 | −90 | 480 | −80 |
| 5 | A | nil | 25 | d | 52 | −80 | 290 | −80 |
| 6 | B | 6.8 | 30 | b | 56 | −105 | 500 | −40 |
| 7 | B | nil | 30 | b | 55 | −90 | 310 | −40 |
| 8 | C | 3.3 | 16 | c | 62 | −96 | 680 | −60 |
| 9 | C | 3.3 | 16 | c | 61 | −80 | 400 | −60 |
| 10 | D | 1.9 | 18 | d | 62 | −90 | 710 | −80 |
| 11 | D | 1.5 | 18 | d | 61 | −72 | 500 | −80 |
| 12 | E | 2.2 | 30 | c | 48 | −25 | 280 | −20 |
| 13 | E | 2.2 | 30 | c | 46 | +10 | 150 | −20 |
| 14 | E | 6.1 | 30 | c | 49 | −15 | 220 | −20 |
| 15 | E | nil | 30 | c | 49 | +35 | 120 | 0 |
| 16 | F | 2.8 | 50 | e | 97 | −105 | 550 | −40 |
| 17 | F | nil | 50 | e | 95 | −90 | 400 | −40 |
| 18 | F | 3.6 | 50 | e | 95 | −110 | 650 | −40 |
| 19 | G | 6.5 | 32 | f | 153 | −77 | 700 | −196 |
| 20 | G | nil | 32 | f | 148 | −35 | 550 | −196 |
| 21 | H | 2.8 | 20 | e | 90 | −160 | 660 | −100 |
| 22 | H | 1.6 | 20 | e | 89 | −135 | 480 | −100 |
| 23 | H | nil | 20 | e | 85 | −150 | 310 | −100 |
| 24 | I | 1.8 | 40 | b | 59 | −92 | 480 | −40 |
| 25 | I | 0.9 | 40 | b | 56 | −65 | 280 | −40 |
| 26 | J | 2.5 | 18 | d | 67 | −80 | 660 | −80 |
| 27 | J | nil | 18 | d | 65 | −60 | 300 | −80 |
| 28 | K | 2.2 | 30 | b | 61 | −72 | 380 | −40 |
| 29 | K | nil | 30 | b | 60 | −65 | 250 | −40 |
| 30 | L | 2.1 | 25 | e | 60 | −96 | 500 | −80 |
| 31 | L | 2.6 | 25 | e | 58 | −70 | 250 | −80 |
| 32 | M | 2.3 | 12 | e | 66 | −110 | 690 | −80 |

TABLE 6(2)-continued

| Plate No. | Steel No. | Sum of strains imparted to plate surface portion by repeated bending | Plate thickness (mm) | Heat-treatment pattern | Mechanical properties: Tensile strength ($kgf/mm^2$) | Ductile-brittle transition temp. (°C.) | Kca value ($kgf/mm^{1.5}$) | Temp. exhibiting Kca value (°C.) |
|---|---|---|---|---|---|---|---|---|
| 33 | M | 2.2 | 12 | e | 64 | −80 | 310 | −80 |

Notes
(1) JIS No. 4 testpiece was used for both tensile test and impact test (¼t - L direction).
(2) Temperature gradient type ESSO test was used for arrest test.

We claim:

1. A method of producing a strong and tough thick steel plate, comprising:

casting a steel consisting of 0.02 to 0.30 wt % of C, 0.01 to 2.0 wt % of Si, 0.30 to 3.5 wt % of Mn, 0.003 to 0.10 wt % of Al, and the balance of Fe and unavoidable impurities, into an ingot or a slab;

hot rolling said ingot or said slab at a cumulative reduction ratio of at least 20% in a temperature region higher than an $Ar_3$ transformation point in succession to said casting or after heating, to obtain a hot rolled steel plate having an austenite texture;

applying repeated bending to said hot rolled steel plate in an austenite non-recrystallization temperature region or in a temperature region higher than said $Ar_1$ transformation point but lower than an $Ar_3$ transformation point so as to impart a cumulative strain quantity E (%) expressed by the following formula; and cooling the resulting bent work so as to transform austenite crystal grains in said bent work to fine ferrite crystal grains;

$$-1.14\times10^{-3}T+2.4>E\geqq1.71\times10^{-3}T-0.4$$

where

E: sum (%) of the strains which a plate surface receives by repeated bending,

T: temperature (°C.) of the plate surface when said repeated bending is carried out, within the region of $Ar_1$ to 1,000° C.

2. A method according to claim 1, wherein, when rolling is carried out in succession to casting of said ingot or said slab or after re-heating it, said ingot or said slab is cooled from a temperature region higher than the $Ac_3$ point before, or during, rolling, so as to form an austenite-ferrite two-phase texture or a ferrite single phase texture at a portion having a thickness of at least 5% from the surface of said ingot or said slab, rolling is then carried out at a cumulative reduction ratio of at least 20% in the temperature region of said texture in the process of a temperature rise due to recuperation of said ingot or said slab so as to convert said texture to an austenite single phase texture during, or after, rolling, and thereafter repeated bending is carried out in an austenite non-recrystallization temperature region higher than the $Ar_1$ point so as to impart a cumulative strain quantity E expressed by the following formula:

$$-1.14\times10^{-3}T+24>E\geqq1.65\times10^{-3}T-0.5\ (\%)$$

where T: $Ar_1$ to 1,000° C.

3. A method according to claim 2, wherein cooling water is sprayed at a rate of 0.05 to 1.0 $m^3/min\cdot m^2$ to said ingot or said slab before, or during, rolling from a temperature region higher than $Ac_3$.

4. A method according to claim 1, wherein at least one kind of the member selected from each of the following groups (a) to (e) is further added:

(a) 0.001 to 0.10 wt % of material selected from group consisting of Nb and Ti, (b) at least one member selected from the group consisting of Cu: 0.05 to 3.0 wt %, Ni: 0.05 to 10.0 wt %, Cr: 0.05 to 10.0 wt %, Mo: 0.05 to 3.5 wt %, Co: 0.05 to 10.0 wt % and W: 0.05 to 2.0 wt %, (c) V: 0.002 to 0.10 wt %, (d) B: 0.0003 to 0.0025 wt %, and (e) material selected from the group consisting of Rem: 0.002 to 0.10 wt % and Ca: 0.0003 to 0.0040 wt %.

5. A method according to claim 1, wherein said steel material subjected to said repeated bending is left standing for cooling before said repeated bending.

6. A method according to claim 1, wherein said steel material subjected to said repeated bending is left standing for cooling at a mean rate of 0.5 to 80° C./S of thickness of the plate.

7. A method of producing a strong and tough thick steel plate, comprising:

casting a steel consisting of 0.02 to 0.30 wt % of C, 0.01 to 2.0 wt % of Si, 0.30 to 3.5 wt % of Mn, 0.003 to 0.10 wt % of Al and the balance consisting of Fe and unavoidable impurities, into an ingot or a slab;

hot rolling said ingot or said slab in succession to said casing or after heating, at a cumulative reduction ratio of at least 20% in an austenite non-recrystallization temperature region;

applying repeated bending to said hot rolled steel plate in the austenite non-recrystallization temperature region or a temperature region lower than an $Ar_3$ transformation point but higher than an $Ar_1$ transformation point so as to impart a cumulative strain quantity E (%) expressed by the following formula and to obtain fine austenite recrystallized grains; and cooling the resulting bent work to transform said austenite recrystallized grains to fine ferrite crystal grains:

$$E\geqq-1.14\times10^{-3}T_2+2.4$$

where

E: sum (%) of strains which the plate surface receives by said repeated bending, $T_2$: temperature (°C.) of the plate surface when said repeated bending is carried out, within higher than $Ar_1$.

8. A method of claim 7, wherein at least one member selected from the following groups (a) to (e) is further added:

(a) 0.001 to 0.10 wt % of material selected from group consisting of Nb and Ti;

(b) at least one member selected from the group consisting of Cu: 0.05 to 3.0 wt %, Ni: 0.05 to 10.0 wt %, Cr: 0.05 to 10.0 wt %, Mo: 0.05 to 3.5 wt%, Co: 0.05 to 10.0 wt % and W: 0.05 to 2.0 wt %, (c) V: 0.002 to 0.10 wt %, (d) B: 0.0003 to 0.0025 wt %, and (e) material selected from the group consisting of Rem: 0.002 to 0.10 wt %, and Ca: 0.0003 to 0.0040 wt %.

9. A method according to claim 7, wherein said steel material subjected to said repeated bending is left standing for cooling.

10. A method according to claim 7, wherein said steel material subjected to said repeated bending is cooled at a mean cooling rate of 0.5 to 80° C./S in the direction of thickness of the plate.

11. A method of producing a strong and tough thick steel plate, comprising:

casting a steel consisting of 0.02 to 0.30 wt % of C, 0.01 to 2.0 wt % of Si, 0.30 to 3.5 wt % of Mn, 0.003 to 0.10 wt % of Al and the balance consisting of Fe and unavoidable impurities to form a crude steel billet;

cooling said crude steel billet in succession to said casting or after heating, from a temperature region higher than an $Ac_3$ point to convert a texture to an austenite-ferrite dual phase state or a ferrite single phase state at a portion of at least 5% from both surfaces of said crude steel billet in the direction of thickness;

rolling said crude billet at a cumulative reduction ratio of at least 20% in the temperature region of said texture state during a temperature rise process by recuperative heat of said crude steel billet, and raising the surface temperature of the resulting hot-rolled plate to a temperature in the region of from ($Ac_3$ point minus 200° C.) to a point less than the $Ac_3$ point after completion of rolling;

applying subsequently repeated bending in said temperature region, where the austenite-ferrite dual phase region exists, so as to impart a cumulative strain quantity E (%) expressed by the following formula and to obtain fine ferrite recrystallized grains; and cooling the resulting bent work so as to inhibit the grain growth of the recrystallized ferrite grains:

$$E \geqq -1.2\times10^{-3}T_3+2.7(\%)$$

where

E: sum (%) of the strains which a plate surface receives by repeated bending, $T_3$: temperature (°C.) of the plate surface when said repeated bending is carried out, within the region of not higher than $Ac_3$.

12. A method according to claim 11, wherein cooling water is sprayed at a rate of 0.05 to 1.0 $m^3/min\cdot m^2$ from a temperature region higher than $Ac_3$ point before, or during, rolling of said ingot or said slab.

13. A method according to claim 12, wherein at least one member selected from the following groups (a) to (e) is further added:

(a) 0.001 to 0.10 wt % of material selected from group consisting of Nb and Ti;

(b) at least one member selected from the group consisting of Cu: 0.05 to 3.0 wt %, Ni: 0.05 to 10.0 wt %, Cr: 0.05 to 10.0 wt %, Mo: 0.05 to 3.5 wt %, Co: 0.05 to 10.0 wt %, and W: 0.05 to 2.0 wt %, (c) V: 0.002 to 0.10 wt %, (d) B: 0.003 to 0.0025 wt %, and (e) material selected from the group consisting of Rem: 0.002 to 0.10 wt % and Ca: 0.0003 to 0.0040 wt %.

14. A method according to claim 11, wherein said steel material subjected to said repeated bending is left standing for cooling.

15. A method according to claim 11, wherein cooling is carried out at a mean cooling rate of 0.5 to 80° C./S in the direction of thickness.

* * * * *